US008967768B2

(12) United States Patent
Jogo et al.

(10) Patent No.: US 8,967,768 B2
(45) Date of Patent: Mar. 3, 2015

(54) INKJET PRINTING APPARATUS AND INKJET PRINTING METHOD

(71) Applicant: Canon Kabushiki Kaisha, Tokyo (JP)

(72) Inventors: Jumpei Jogo, Kawasaki (JP); Masaki Nitta, Yokohama (JP); Satoshi Hayashi, Yokohama (JP); Yuhei Oikawa, Yokohama (JP); Joji Katsuura, Kawasaki (JP); Kosuke Matsushita, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 92 days.

(21) Appl. No.: 13/659,054

(22) Filed: Oct. 24, 2012

(65) Prior Publication Data

US 2013/0050337 A1 Feb. 28, 2013

Related U.S. Application Data

(62) Division of application No. 12/722,037, filed on Mar. 11, 2010, now Pat. No. 8,317,287.

(30) Foreign Application Priority Data

Mar. 18, 2009 (JP) ..... 2009-066325

(51) Int. Cl.
*B41J 23/00* (2006.01)
*B41J 2/165* (2006.01)
(Continued)

(52) U.S. Cl.
CPC ..... *B41J 2/16526* (2013.01); *B41J 2/17553* (2013.01); *B41J 29/38* (2013.01)
USPC ..... 347/37

(58) Field of Classification Search
CPC ..... B41J 29/38; B41J 2/17553; B41J 2/16526
USPC ..... 347/37
See application file for complete search history.

(56) References Cited

U.S. PATENT DOCUMENTS 6,435,671 B1 * 8/2002 Kim et al. ..... 347/68
6,527,361 B1 * 3/2003 Gotoh et al. ..... 347/30
(Continued)

FOREIGN PATENT DOCUMENTS

JP 6-115097 A 4/1994
JP 07-009723 A 1/1995
(Continued)

OTHER PUBLICATIONS

Mar. 12, 2013 Japanese Office Action in Japanese Patent Application No. 2009-066325.
(Continued)

*Primary Examiner* — Alessandro Amari
*Assistant Examiner* — Alexander C Witkowski
(74) *Attorney, Agent, or Firm* — Fitzpatrick, Cella, Harper & Scinto

(57) ABSTRACT

An inkjet printing apparatus and an inkjet printing method are realized which can improve a print quality while minimizing the volume of waste ink, running cost and throughput degradations. For this purpose, the scan width is set according to the size and position of the print medium and then, based on that scan width, a location where the preliminary ejections are to be executed and the number of times that the preliminary ejection is to be executed in a single preliminary ejection session are determined.

10 Claims, 9 Drawing Sheets

(51) Int. Cl.
*B41J 2/175* (2006.01)
*B41J 29/38* (2006.01)

(56) References Cited

U.S. PATENT DOCUMENTS

| | | | | |
|---|---|---|---|---|
| 6,609,777 | B2 * | 8/2003 | Endo | 347/19 |
| 7,216,947 | B2 | 5/2007 | Kusunoki | |
| 7,367,654 | B2 | 5/2008 | Togashi et al. | |
| 7,503,638 | B2 | 3/2009 | Sato et al. | |
| 7,735,946 | B2 | 6/2010 | Tanaka et al. | |
| 8,136,908 | B2 | 3/2012 | Tanaka et al. | |
| 2002/0171713 | A1 * | 11/2002 | Ueno et al. | 347/49 |
| 2004/0141021 | A1 * | 7/2004 | Yamamoto et al. | 347/16 |
| 2005/0185039 | A1 | 8/2005 | Garbacz | |
| 2005/0206682 | A1 | 9/2005 | Togashi et al. | |
| 2005/0270323 | A1 * | 12/2005 | Oshio et al. | 347/14 |
| 2006/0187258 | A1 * | 8/2006 | Asanuma | 347/36 |
| 2006/0214958 | A1 * | 9/2006 | Inoue | 347/5 |
| 2007/0279444 | A1 | 12/2007 | Hayashi et al. | |
| 2008/0278528 | A1 | 11/2008 | Kim | |

FOREIGN PATENT DOCUMENTS

| | | | |
|---|---|---|---|
| JP | 2001-180010 | A | 7/2001 |
| JP | 2005-349604 | A | 12/2005 |
| JP | 2006-218667 | A | 8/2006 |
| JP | 2006-272597 | A | 10/2006 |
| JP | 2007-326282 | A | 12/2007 |

OTHER PUBLICATIONS

Office Action issued in Japanese Patent Office Application No. 2009-066325, dated Dec. 18, 2012.

* cited by examiner

INKJET PRINTING APPARATUS AND INKJET PRINTING METHOD

This application is a divisional of U.S. patent application Ser. No 12/722,037, filed Mar. 11, 2010.

BACKGROUND OF THE INVENTION

1. Field of the Invention

The present invention relates to an inkjet printing apparatus and an inkjet printing method.

2. Description of the Related Art

Ink used in an inkjet printing apparatus is a liquid, so that, if nozzles of a print head are exposed to open air, ink in the nozzles may become viscous or stick to the interior of the nozzles. This in turn may cause an improper ejection in which landing positions of ink droplets deviate from intended ones, or an ejection failure in which ink droplets fail to be squirted at all, degrading a quality of printed images.

To deal with this problem, the inkjet printing apparatus has a recovery mechanism or device to eliminate the improper ejection and restore the normal ink ejection performance. This recovery device performs a suction-based recovery operation and a preliminary ejection. The suction-based recovery operation involves generating a negative pressure within a print head by suction or pressurization to suck out ink from the print head. The preliminary ejection causes the print head to eject ink without regard to the printing operation. These recovery operations are performed after the nozzles have been exposed to open air for a predetermined period of time, in order to discharge from the nozzles viscous ink and nozzle-sticking ink.

The preliminary ejection is normally performed at a cap, that is located near the home position and used for a suction-based recovery operation, and also at a preliminary ejection port (located, for example, across the print area from the home position). However, since the preliminary ejection is done separately from the normal printing operation, it takes time in addition to the time spent for printing. This means that as the number of preliminary ejections increases, throughput will inevitably deteriorate. That is, the number of preliminary ejections greatly influences the throughput.

Under these circumstances, Japanese Patent Laid-Open No. 2005-349604 discloses a method that involves acquiring information on a print medium size and a print medium feed position in the direction of scan (i.e., whether it is on the reference side or not) and, based on the information thus acquired, setting from the cap and the preliminary ejection port a combination of positions where the preliminary ejection is to be performed.

For example, a check is made as to whether the size (width) in the scan direction of the print medium is less than half a maximum scan width of the carriage. If the print medium size is found to be greater than half the maximum scan width, a setting is made to execute the preliminary ejection both at the cap, which is located on the reference side (home position side), and at the preliminary ejection port on the opposite side. If the width of the print medium is less than half the maximum scan width and the print medium feed position is on the reference side, the preliminary ejection is set to be executed only at the cap.

This enables the preliminary ejection execution position to be controlled appropriately without lowering throughput.

With the control method disclosed in Japanese Patent Laid-Open No. 2005-349604, however, the position where the preliminary ejection is performed is determined only from the information on the size and position of the print medium. So, when the print medium is large in size, even if a small-size image is to be printed in an area near the reference side, the preliminary ejection is performed both at the cap on the reference side and at the preliminary ejection port on the non-reference side.

SUMMARY OF THE INVENTION

That is, since the method disclosed in Japanese Patent Laid-Open No. 2005-349604 determines the location where the preliminary ejections are to be performed, without regard to the actual print range (a range in which the carriage scans), there is a possibility that the preliminary ejection may be executed also at a preliminary ejection port remote from the actual print range. This method therefore needs further improvements in minimizing throughput degradations caused by the preliminary ejections.

Therefore the inkjet printing apparatus of this invention comprises: a printing unit to print an image on a print medium by ejecting an ink based on image data while scanning a print head for ejecting the ink in a scanning direction; a first preliminary ejection receiving unit and a second preliminary ejection receiving unit provided on both sides of a scanning range of the printing unit scanning, and receiving the ink preliminarily ejected by the printing head; an acquisition unit to acquire a size of the printing medium and a range of the scanning direction of the image data; a decision unit to determine the preliminary ejection receiving unit that receives preliminary ejection from the first preliminary ejection receiving unit and the second preliminary ejection receiving unit based on the size of the printing medium and a range of the image data.

Further, the inkjet printing method of this invention comprises: a step to print an image on a print medium by ejecting an ink based on image data while scanning a print head for ejecting the ink in a scanning direction; a step to acquire a size of the printing medium and a range of the scanning direction of the image data; a step to determine the preliminary ejection receiving unit that receives preliminary ejection from the first preliminary ejection receiving unit and the second preliminary ejection receiving unit based on the size of the printing medium and a range of the image data.

With this invention, preliminary ejections are realized that can make throughput degradations as small as possible.

Further features of the present invention will become apparent from the following description of exemplary embodiments (with reference to the attached drawings).

DESCRIPTION OF THE EMBODIMENTS (First Embodiment)

A first embodiment of this invention will be described by referring to the accompanying drawings. It is noted here that constitutional elements in the following embodiments are presented only as exemplary ones and that the scope of the invention is not intended to be limited to these embodiments.

In this application, a word "printing" signifies not only forming significant information such as characters and figures but also generally forming images, patterns or the like on a wide variety of print mediums, whether they are significant or non-significant or whether or not they are visibly recognizable to humans. Further, the word "printing" is also intended to include processing of print mediums. A word "print medium" signifies not only paper generally used in common printing apparatus but also any kind of materials that can receive ink, such as cloth, plastic films, metal sheets, glass, ceramics, wood and leather.

Further, a word "ink" (also referred to as "liquid") is to be construed broadly as in the definition of the "printing". Such an ink is intended to represent any liquid that can be used to form images, patterns or the like by being applied onto a print medium or to process the print medium and ink (e.g., to coagulate or insolubilize a colorant in ink applied to the print medium). Further, a word "nozzle" is intended, unless otherwise specifically noted, to refer generally to an ejection opening or a liquid passage communicating with it, and also to an element designed to produce an energy for ink ejection.

(Outline of Inkjet Printing Apparatus)

Figure 1:
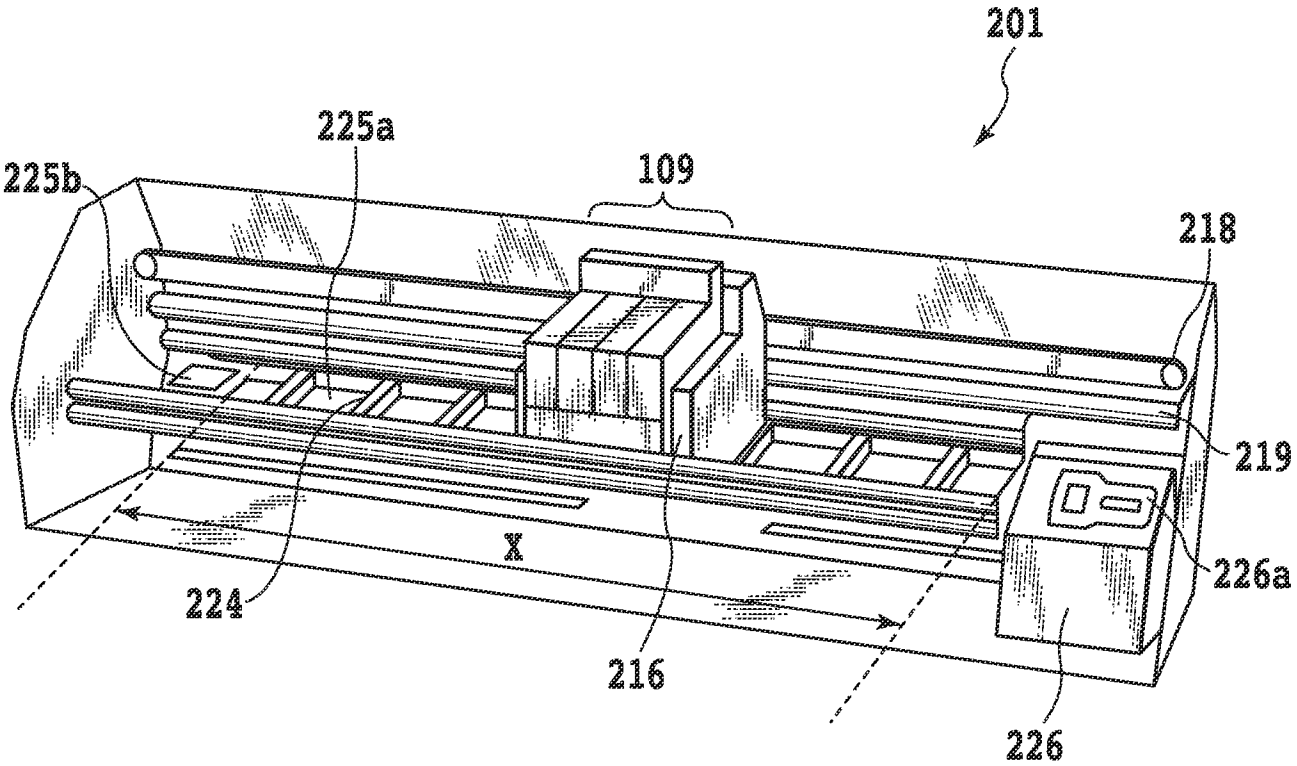
FIG. 1 is an external perspective view showing a construction of essential parts in an inkjet printing apparatus of this invention.
Figure 2:
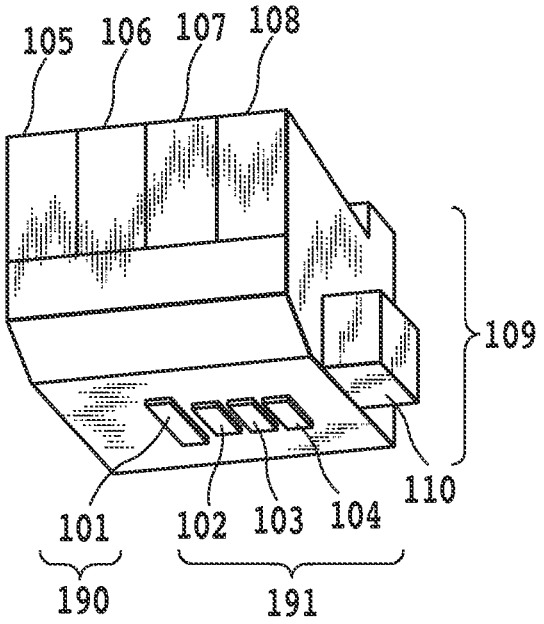
FIG. 2 is an external perspective view showing a schematic construction of a head cartridge in the inkjet printing apparatus of FIG. 1.

First, the outline of an inkjet printing apparatus (also referred to simply as a printing apparatus) of this invention that is commonly used in embodiments that follow will be explained. FIG. 1 is an external perspective view showing a construction of essential parts in the inkjet printing apparatus of this invention. FIG. 2 is an external perspective view showing an outline construction of a head cartridge in the inkjet printing apparatus of FIG. 1. Inkjet print heads (also referred to simply as print heads) 101-104 produce thermal energy by a thermal energy converter in their print unit to form bubbles which in turn squirt ink from a plurality of nozzles onto a print medium. Pluralities of nozzles in the print heads 101-104 are arranged in a plurality of arrays and these are called nozzle arrays. A print head unit 190 is dedicated to ejecting a black pigment ink, and a print head unit 191 is dedicated to a cyan (C) dye ink, a magenta (M) dye ink and a yellow (Y) dye ink.

The inkjet print head cartridge 109 is integral with the print heads 101-104, with ink tanks 105-108 individually removably attached thereto. In the construction shown in FIG. 2, the ink tanks 105-108 accommodate a pigment black ink, a dye cyan ink, a dye magenta ink and a dye yellow ink, respectively.

In the inkjet printing apparatus presented above, because of a poor quality of characters on plain paper printed with dye inks, a pigment ink is used as a black ink to improve the print quality of characters when they are printed in black on plain paper. In cases where photographic images are printed on dedicated paper with a coated print surface or on label surfaces of CD-R and DVD-R, the pigment ink cannot be used because of its characteristics and the printing is done using dye inks only. It is noted here that this ink set can be arranged appropriately according to the nature of its use and that there is no limitation in the number and color of the dye inks or pigment inks mounted on the head cartridge.

A print medium optical detector 110 can be installed as situations demand and has a light emitting part and a light receiving part to detect a boundary between a print medium region and other region of the printing apparatus body composed of such members as a platen 224. Generally, the print medium has a higher luminance and therefore a higher reflectance than those of the printing apparatus body. A difference between electrical outputs from the two regions that stems from their different optical characteristics allows detection of edges of the print medium, thus revealing its size. The print medium optical detector 110 is so constructed that it can be installed at any desired location on a carriage 216 according to the construction of the inkjet printing apparatus. In this embodiment, it is mounted on one side of the print head cartridge 109 as shown in the figure. The use of the print medium optical detector 110 is not a necessary requirement and there are also inkjet printing apparatus not equipped with the detector.

In FIG. 1, the inkjet printing apparatus body 201 is electrically and mechanically connected with the print head cartridge 109 when the latter is removably installed in the carriage 216. When the inkjet print head cartridge 109 is mounted on the carriage 216, the nozzle arrays of the print heads 101-104 face the print surface of the print medium carried onto the platen 224. The carriage 216 is secured to a part of a drive belt 218, which transmits the drive force of a drive motor (304 in FIG. 3 described later), so that the inkjet print heads 101-104 can reciprocally slide along a guide shaft 219 over the entire width of the print medium. In FIG. 1, a portion designated X represents the length of a maximum scan region and the printing can be performed on a print medium with a width less than this length.

Driving the inkjet print heads 101-104 as they are reciprocally moved can cause an image to be formed on a print medium. Each time one main scan is completed, a subscan to advance the print medium a predetermined distance is executed. A head recovery device (recovery unit) 226 is located near one end of the reciprocal movement path of the inkjet print heads 101-104, for example, near the home position. The head recovery device 226 is operated by the drive force of the motor through a transmission mechanism to cap the print head units 190, 191. With the print head units 190, 191 capped by a cap **226*a* of the head recovery device 226, ink is sucked out of the print head units 190, 191 by a suction means (suction pump) installed in the head recovery device 226. This operation is called a suction-based recovery operation. Capping the print head units 190, 191 with the cap 226*a* as when the printing operation is finished can prevent ink evaporation from the print head units 190, 191 and protect the front face (ejection surface) of the inkjet print head. By performing a preliminary ejection on this cap 226*a***, dirt and viscous ink can be removed from the nozzles thus restoring the ink ejection performance to the normal state.

On the opposite side across the carriage movement range from where the head recovery device 226 (cap **226*a*) is installed, there are a plurality of preliminary ejection ports 225. So, the preliminary ejection is controlled to be performed also at the preliminary ejection ports 225 in addition to the cap 226***a*. Of the preliminary ejection ports 225 (second preliminary ejection receiving unit), a preliminary ejection port 225*a* is used for preliminary ejection when a print medium 24 inches wide is printed and a preliminary ejection port 225*b* is intended for use when a print medium 36 inches wide is printed. The printing apparatus of this embodiment is provided with a plurality of preliminary ejection ports, which allows the preliminary ejection to be executed using a preliminary ejection port appropriate for the size of the print medium and closest to the reference side. This contributes to reducing the number of unnecessary carriage scans. In the printing apparatus of this embodiment, the home position side of the carriage movement range or carriage stroke, where the cap 226*a* (first preliminary ejection receiving unit) is installed, is taken to be the reference side. A print medium is kept to the reference side as it is supplied and fed.

Figure 3:
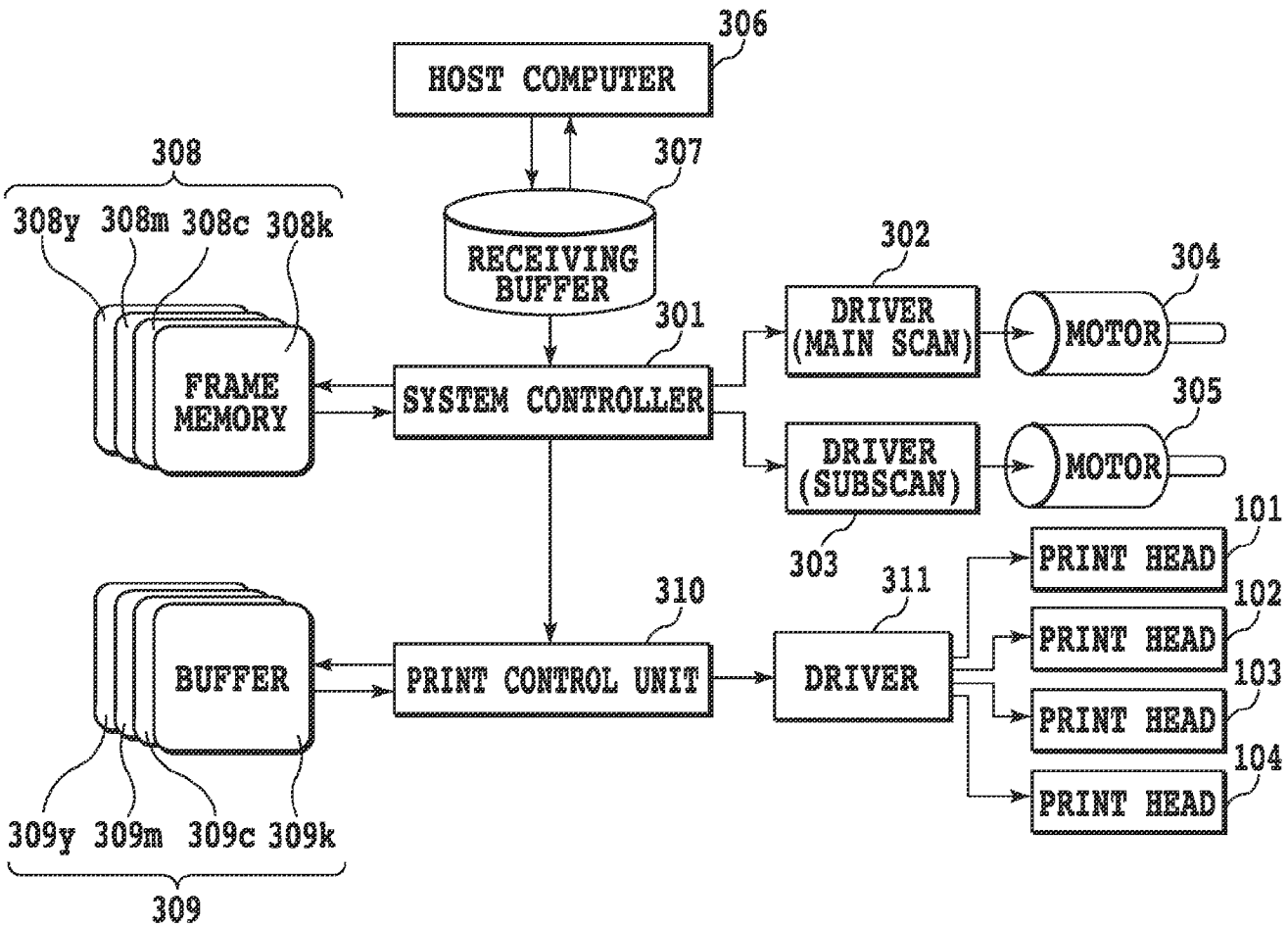
FIG. 3 is a block diagram showing a configuration of a control system in the inkjet printing apparatus.

FIG. 3 is a block diagram showing a configuration of a control system in the inkjet printing apparatus described above. A system controller 301 controls the entire apparatus and has, for example, a microprocessor (MPU), a ROM storing a control program and a RAM used as a work area by the microprocessor during processing. The system controller 301 controls the preliminary ejection according to the control program and instructs a print control unit 310 described later on a timing of executing the preliminary ejections. It is noted that major controls of the inkjet printing apparatus of this invention, including the control of the preliminary ejection, may be placed under the control of a host computer 306.

A driver 302 controls a motor 304 for moving (main-scanning) the carriage 216 carrying the inkjet print head cartridge. In this embodiment the driver 302 is controlled to lower the speed of the carriage 216. A driver 303 controls a motor 305 for feeding a print medium in the subscan direction. The host computer 306 is a host device to transfer print data, control data and others to the printing apparatus of this invention. A receiving buffer 307 temporarily holds data received from the host computer 306 until it is read into the system controller 301.

A frame memory 308 (308*k*, 308*c*, 308*m*, 308*y*) is provided for each of different ink colors (black, cyan, magenta and yellow) to store and accumulate print data and is of a memory size necessary to print a predetermined area. A buffer 309 (309*k*, 309*c*, 309*m*, 309*y*) temporarily stores one scan of print data for the inkjet print head and is provided for each of different ink colors (black, cyan, magenta and yellow). This buffer 309 stores only one scan of print data that the host computer 306 has prepared by performing color conversion, grayscale correction and binarization processing on data and then sent to the buffer. The print control unit 310 controls the print head under the direction of the system controller 301. It controls a driver 311 described later according to instructions from the system controller 301 in controlling the preliminary ejection of this invention. The driver 311 drives the inkjet print heads 101, 102, 103 and 104 to eject their allocated inks (black, cyan, magenta and yellow). This driver 311 is controlled by a control signal from the print control unit 310 to cause the inkjet print heads 101, 102, 103, 104 to execute the preliminary ejection, too.

Where the print medium detection device 110 is installed as shown in FIG. 2, the system controller 301 determines the length (width) of the print medium in the scan direction based on an output signal from the print medium detection device 110. The width of the print medium may also be acquired from control data (media information) attached to the print data sent from a printer driver of the host computer 306.

Figure 4:
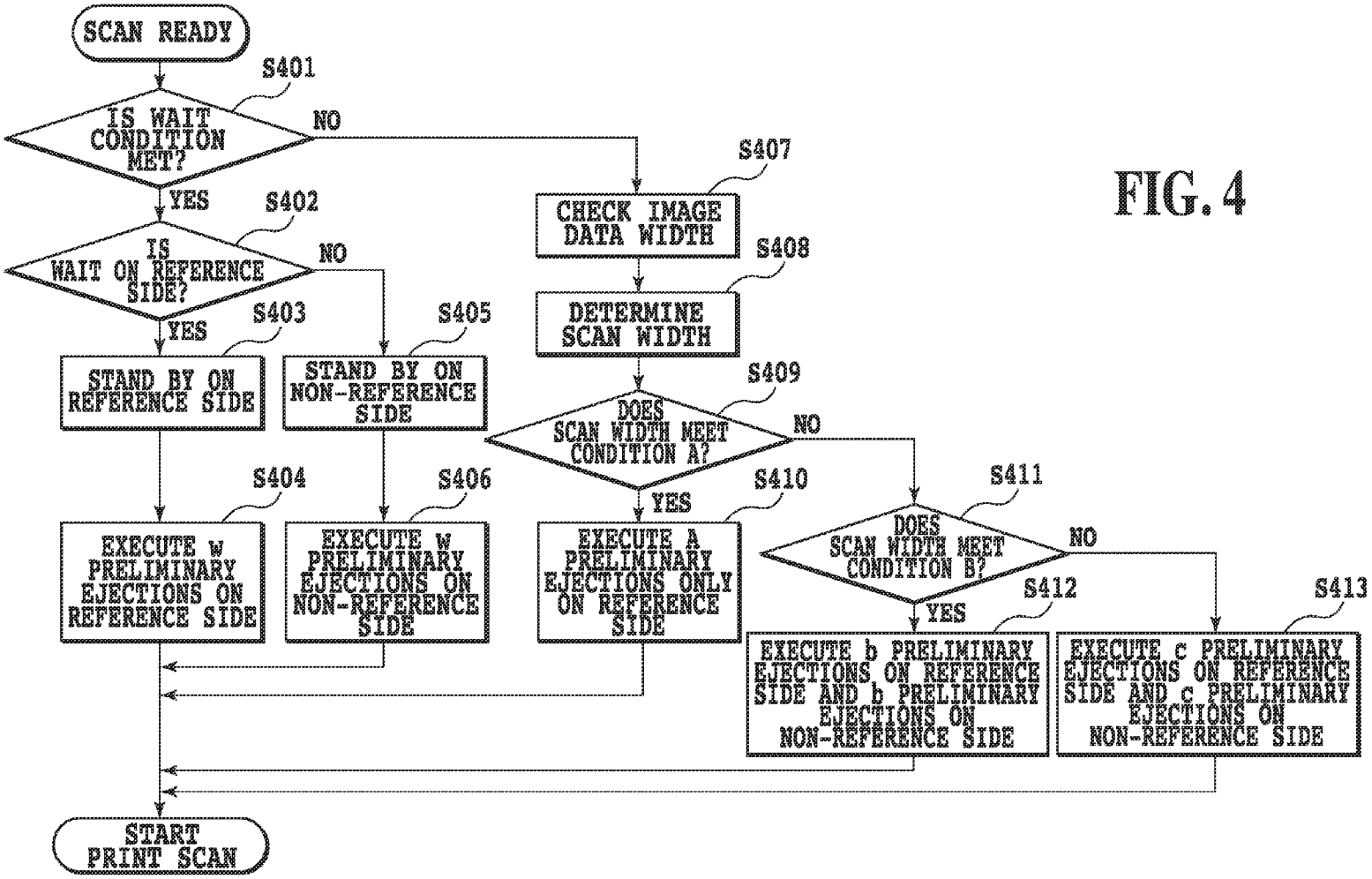
FIG. 4 is a flow chart showing a control sequence of a preliminary ejection in a first embodiment.

FIG. 4 is a flow chart showing a control sequence of the preliminary ejection in this embodiment. In the following, the preliminary ejection control in this embodiment will be explained with reference to this flow chart. When, after the preceding scan is finished, the next scan is ready, the print control unit 310 decides whether a wait (standby time) should be inserted before the next scan. Factors calling for the wait include, for example, a delay of data transfer and a temperature rise in the print head. When a wait is inserted, the print control unit 310 at step S401 measures a wait time and checks if the wait time is in excess of a predetermined threshold (i.e., if a wait condition is met). The method of measuring the wait time may involve determining a time from the previous preliminary ejection to when the next scan starts, or alternatively a time from the end of the previous ejection operation to the start of the next scan, or any other appropriate time.

If a wait is not inserted, or if the weight, though inserted, does not exceed the threshold, failing to meet the wait condition, the print control unit 310 at step S407 examines the width of the print data, Li, from the print data for the next scan stored in the buffer 309. The print data width Li is a distance (width) in the scan direction as measured from the reference side end of a print medium to a far side end of a region where print data (ink ejection data) exists. Next, at step S408 the print control unit 310 determines a scan width Ls, a distance that the carriage actually travels, from the print data width Li and the print medium width Lm.

The method of determining the scan width Ls based on the print data width Li and the print medium width Lm will be explained. The print control unit reads a predetermined program and determines which of condition A, condition B and condition C the scan width Ls satisfies. Here, it is assumed that La<Lb holds, where La and Lb are arbitrary widths (in this embodiment, La=12 inches and Lb=24 inches). First, a check is made as to whether the print data width Li is less than La or not. If Li is found equal to or less than La (Li≤La), the scan width Ls is determined to be the condition A.

Next, if the print data width Li is greater than La (La<Li), a check is made to see if the print medium width Lm is smaller than Lb. If the print medium width Lm is found smaller than Lb, the scan width Ls is determined to be condition B. However, if the print data width Li is greater than La (La<Li) and the print medium width Lm is found greater than Lb, the scan width Ls is determined to be condition C.

Figure 5:
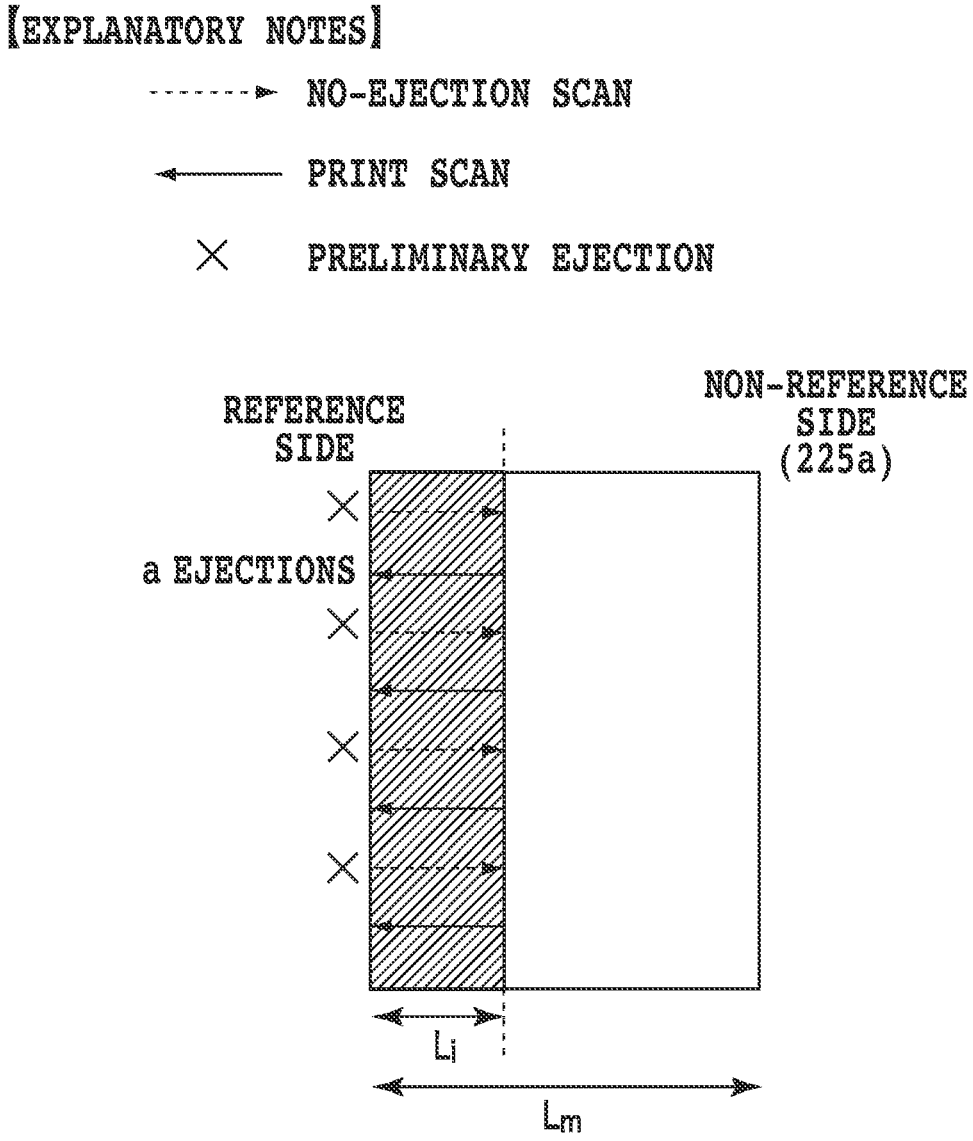
FIG. 5 is a schematic diagram showing a method of executing preliminary ejections as a printing operation is performed on a print medium when a condition A is met in the first embodiment.

At step S409 the print control unit 310 checks whether the scan width Ls has been determined at the previous step. FIG. 5 is a schematic diagram showing the method of executing preliminary ejections as a printing operation is performed on a print medium when the condition A is met. When the scan width Ls satisfies the condition A, the print data width Li is equal to or less than La—a case where, as shown in FIG. 5, only a region on the print medium close to the reference side is scanned for printing. Then, at step S410 the print control unit 310 performs a control to cause only the cap 226*a* on the reference side to execute the preliminary ejection a times. In other words, when the condition A is met, the cap 226*a* on the reference side is made to execute the preliminary ejection a times, followed by the carriage being moved to the non-reference side and, at the point of print data width Li, reversed. Then as the carriage moves toward the reference side, ink is ejected onto the print medium to form an image thereon. In subsequent operations, the similar action is repeated until an intended image is completed on the print medium. Under the condition A, since the carriage is reciprocally moved near the reference side, a degradation of throughput can be minimized by executing the preliminary ejections at only the cap 226*a*. At step S409 if the scan width Ls is found not to satisfy the condition A, the print control unit 310 at step S411 checks if the scan width Ls meets the condition B.

Figure 6:
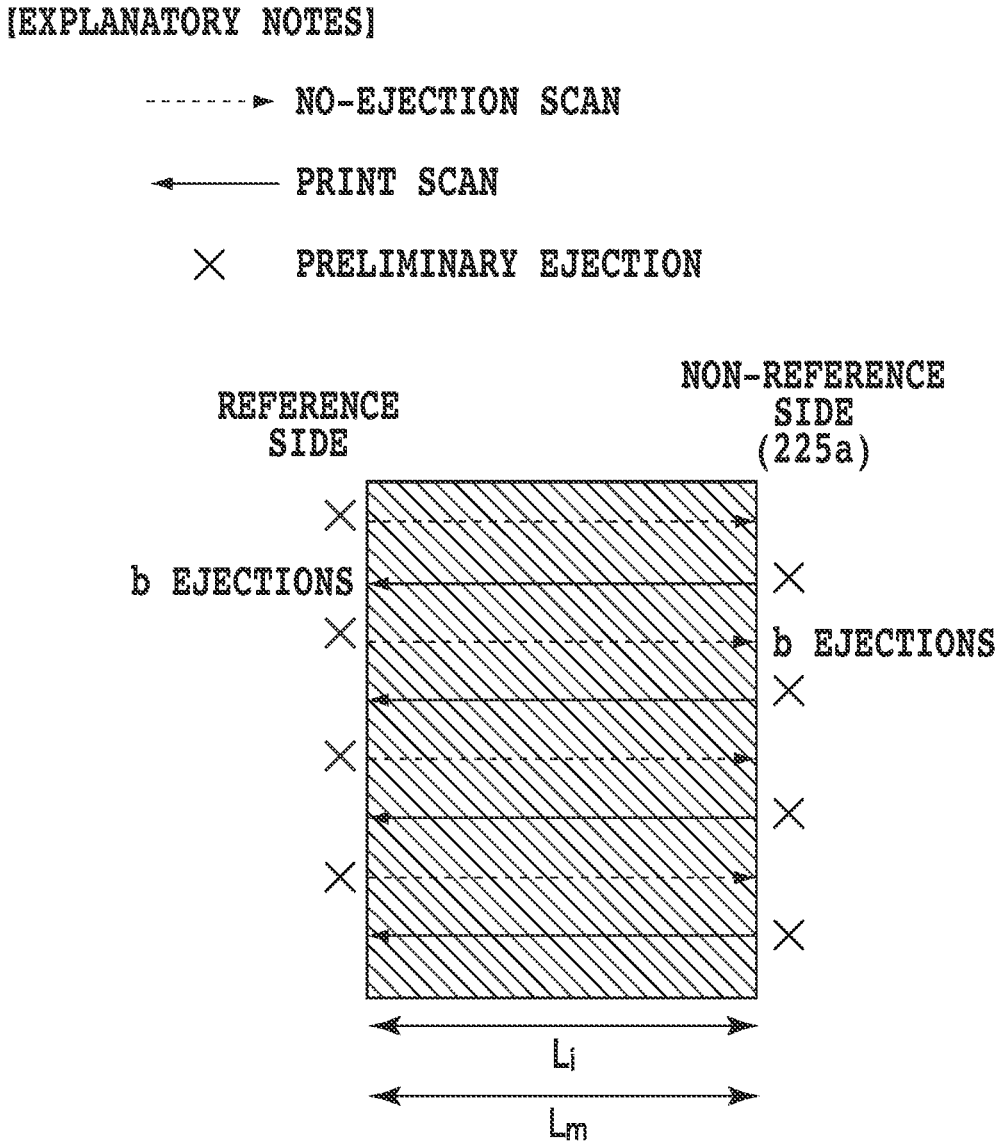
FIG. 6 is a schematic diagram showing a method of executing preliminary ejections as a printing operation is performed on a print medium when a condition B is met in the first embodiment.

FIG. 6 is a schematic diagram showing the method of executing preliminary ejections as a printing operation is performed on a print medium when the condition B is met. When the scan width Ls satisfies the condition B, the print data width Li is greater than La and the print medium width Lm is less than Lb—a case where, as shown in FIG. 6, an almost entire region of the print medium width is scanned for printing. When the print medium width Lm is smaller than Lb (24 inches), the preliminary ejection on the non-reference side uses the preliminary ejection port 225*a* that is provided for use with a 24-inch-wide print medium. Then, at step S412 the print control unit 310 performs a control to execute b preliminary ejections at the cap 226*a* on the reference side and also b preliminary ejections at the preliminary ejection port 225*a* on the non-reference side. In FIG. 6, the cap 226*a* is made to execute the preliminary ejection b times (a<b), followed by the carriage being moved to the non-reference side where the preliminary ejection is executed b times at the preliminary ejection port 225*a*. Then, as the carriage moves toward the reference side, ink is ejected onto the print medium to form an image. In subsequent operations, the similar action is repeated until an intended image is completed on the print medium. In the condition B, since the scan width is greater than that of the condition A, the number of ejections executed in a single preliminary ejection session is set somewhat larger than in the condition A. Further, while the cap on the reference side has a suction mechanism, the preliminary ejection port on the non-reference side has no such suction mechanism, making it impossible for the preliminary ejection port to discharge ink squirted by the preliminary ejections from the print heads. With this taken into consideration, the number of ejections in one preliminary ejection session on the reference side may be set somewhat greater than that on the non-reference side.

Figure 7:
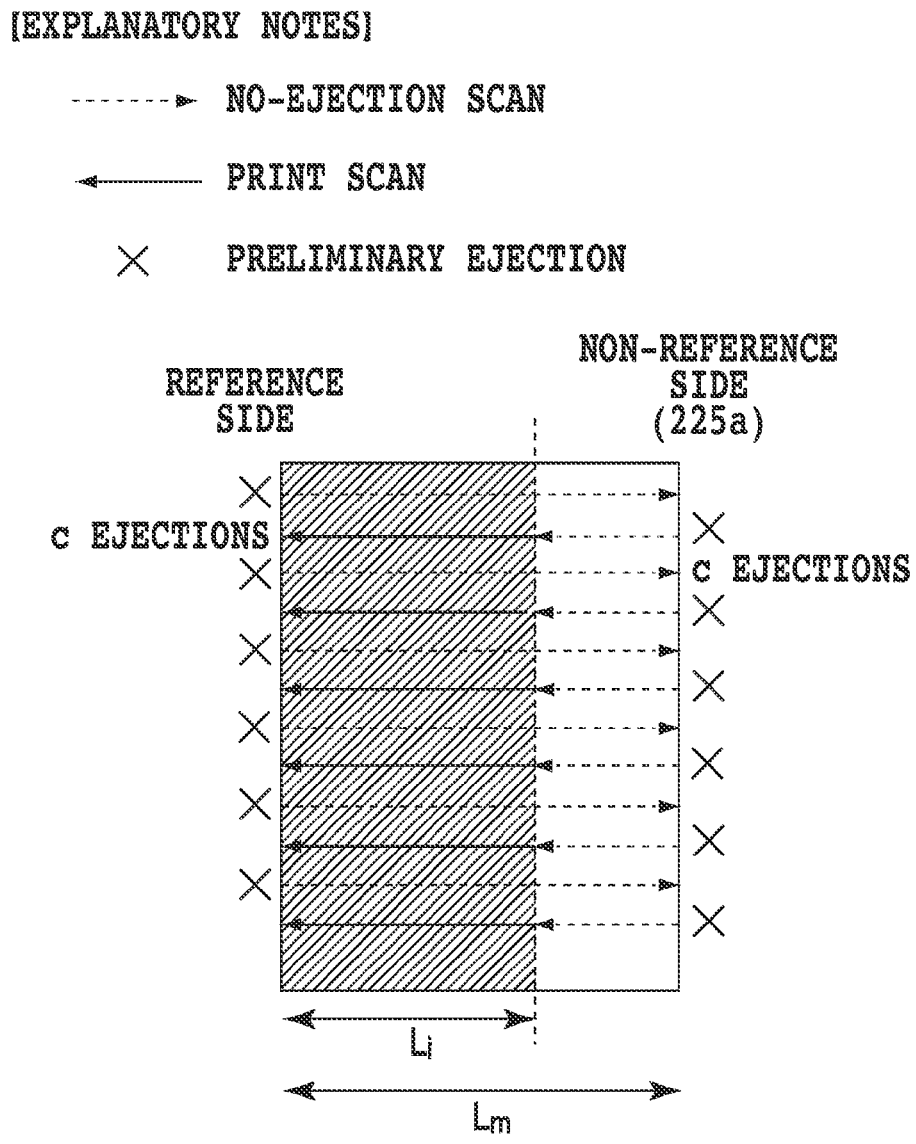
FIG. 7 is a schematic diagram showing a method of executing preliminary ejections as a printing operation is performed on a print medium when a condition C is met where Lb<Lm in the first embodiment.
Figure 8:
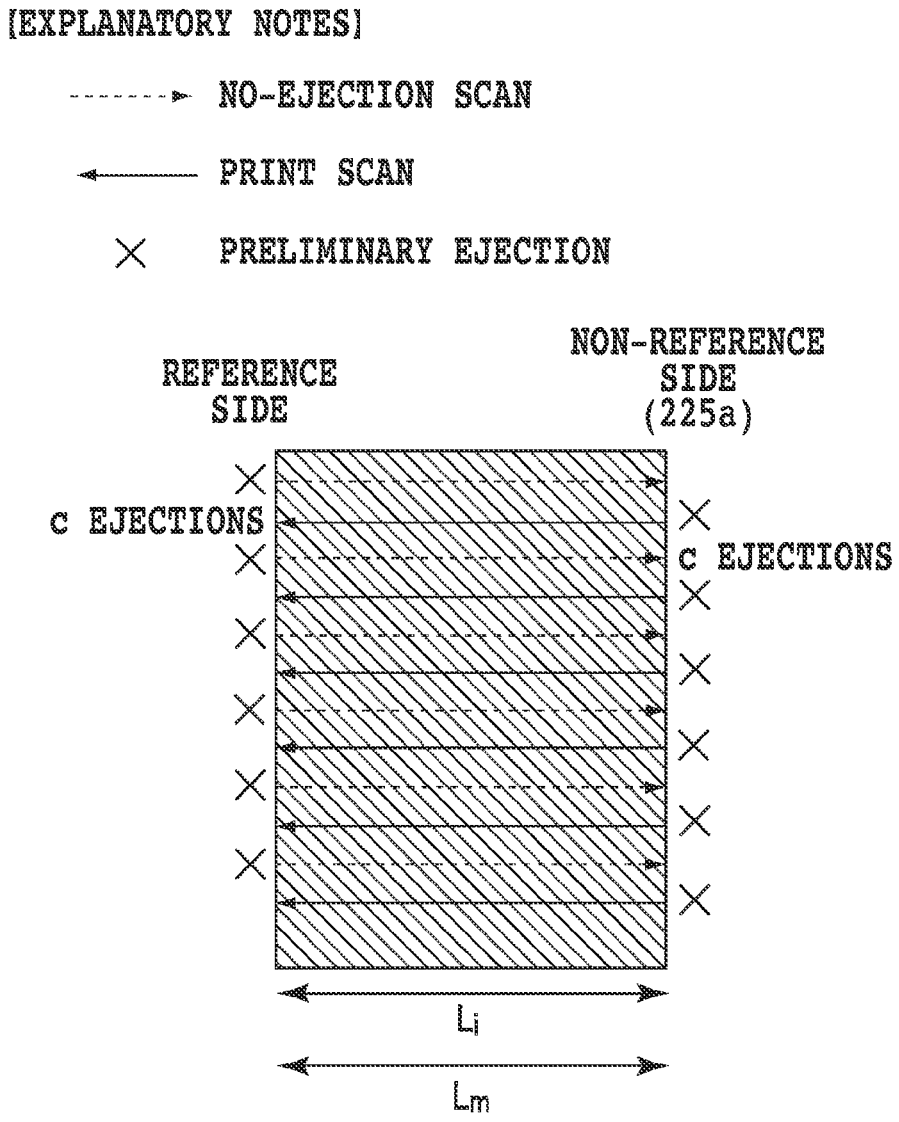
FIG. 8 is a schematic diagram showing a method of executing preliminary ejections as a printing operation is performed on a print medium when a condition C is met in the first embodiment.

If at step S411 the scan width Ls does not meet the condition B, it satisfies the condition C. When the scan width Ls satisfies the condition C, the print data width Li is greater than La and the print medium width Lm is greater than Lb—a case where, as shown in FIG. 7 and FIG. 8, an almost entire region of the print medium width is scanned for printing. When the print medium width Lm is larger than Lb (24 inches), the preliminary ejection on the non-reference side uses the preliminary ejection port 225*b* that is provided for use with a 36-inch-wide print medium. Then, at step S413 the print control unit 310 performs a control to execute c preliminary ejections at the cap 226*a* on the reference side and also c preliminary ejections at the preliminary ejection port 225*a* on the non-reference side. In FIG. 7 and FIG. 8, the cap 226*a* is made to execute the preliminary ejection c times (b<c), followed by the carriage being moved to the non-reference side where the preliminary ejection is executed c times at the preliminary ejection port 225*a*. Then, as the carriage moves toward the reference side, ink is ejected onto the print medium to form an image. In subsequent operations, the similar action is repeated until an intended image is completed on the print medium.

In the above explanation, the relation among the different numbers of preliminary ejections is set as a<b<c, it is not limited to this setting. For example, when the scan width Ls is narrow (the case of condition A), the preliminary ejection may be executed x times at only the cap on the reference side. This eliminates the need to scan the carriage as far as the preliminary ejection port on the non-reference side, minimizing a possible degradation in throughput. Further, when the scan width Ls is somewhat wide (the case of condition B), the preliminary ejection is executed x/2 times at the cap on the reference side and also x/2 times at the preliminary ejection port 225*a* on the non-reference side. Since the printing is a one-way printing (backward printing), the execution of the preliminary ejections also on the non-reference side can significantly reduce the time spent from a preliminary ejection session to the next ink ejection, when compared to a case where the preliminary ejections are performed only on the reference side. This contributes to an improved quality of a printed image. It is noted that in this case, the number of preliminary ejections to be executed both on the reference side and on the non-reference side needs only be x/2 ejections. Therefore, the total number of ejections to be performed in one preliminary ejection session during one reciprocal carriage scan remains unchanged from that of the condition A. On top of that, the amount of waste ink does not increase, nor does the running cost.

Next, when the scan width Ls is wide (the case of condition C), the preliminary ejection needs to be performed a sufficient number of times. In that case, x ejections are executed at the cap on the reference side and x ejections are also executed at the preliminary ejection port on the non-reference side. With this arrangement, a possible quality degradation of printed image can be alleviated even when the scan width Ls is wide.

Figure 9:
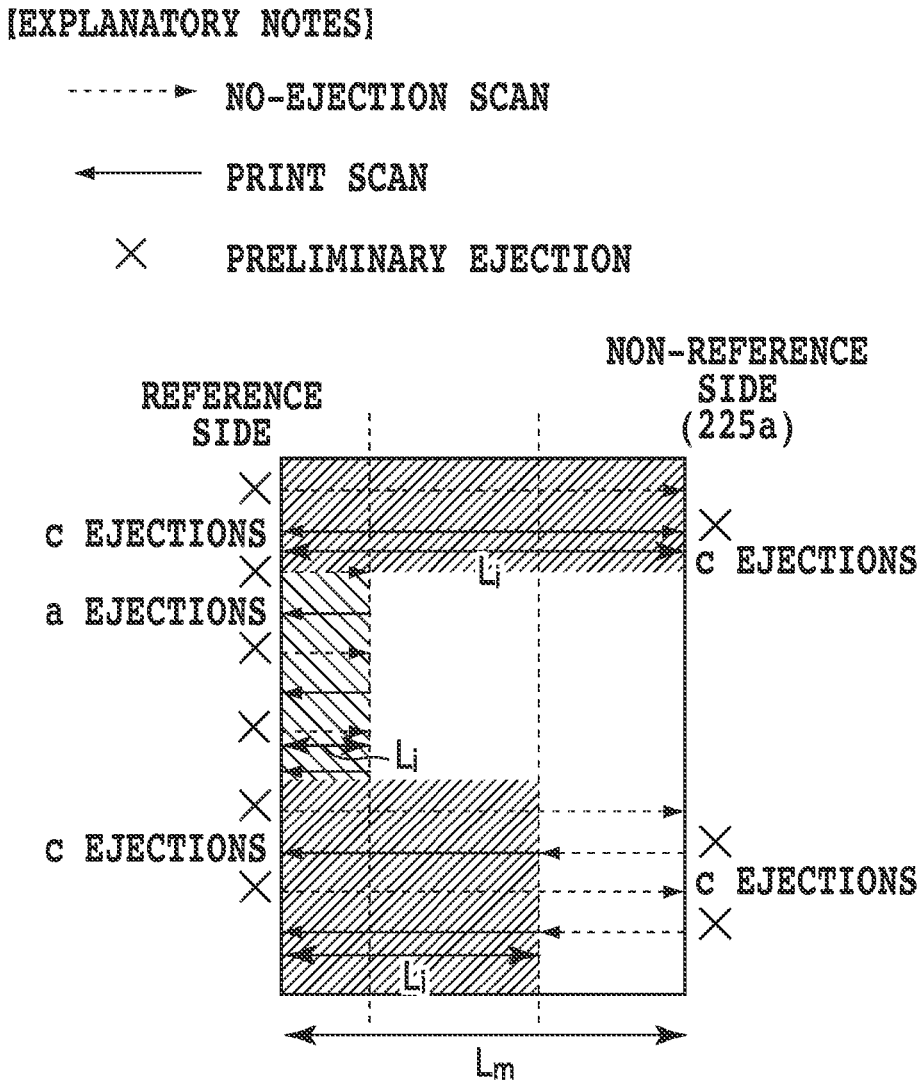
FIG. 9 is a schematic diagram showing a method of executing preliminary ejections as a printing operation is performed on a print medium when the condition A and the condition C mixedly exist in an image being printed.

FIG. 9 is a schematic diagram showing a method of executing preliminary ejections as a printing operation is performed on a print medium when the condition A and the condition C mixedly exist in an image being printed. The print medium width Lm is given as Lb<Lm and the print data width Li as Li≤La, La<Li≤Lb or Lb<Li depending on the position on a print medium. An upper part of the image is defined by Lb<Li and Lb<Lm and therefore meets the condition C. So, in this area the print head scans to the end of the print medium on the non-reference side and performs c preliminary ejections each at the cap 226*a* on the reference side and at the preliminary ejection port 225*b* on the non-reference side. The number of ejections may of course be differentiated between the cap 226*a* on the reference side and the preliminary ejection port 225*b* on the non-reference side.

At a middle part of the image, the image is defined as Li≤La and thus the condition A holds. So, in this area the print head scans over only the print data width Li executing a preliminary ejections at only the cap 226*a* on the reference side. Lastly, a lower part of the image is represented as La<Li≤Lb and Lb<Lm and thus the condition C holds. So, in this area, although the print data width Li is Li≤Lb, the print head scans to the end of the print medium on the non-reference side to execute preliminary ejections. Then, the preliminary ejection is executed c times at both the cap 226*a* on the reference side and the preliminary ejection port 225*b* on the non-reference side. In this case, too, the number of ejections may of course be differentiated between the cap 226*a* on the reference side and the preliminary ejection port 225*b* on the non-reference side.

Next, if step S401 decides that the wait condition is satisfied, step S402 checks if the wait is to be done on the reference side. If it is decided that the wait is inserted on the reference side, step S403 causes the print head to stand by for a predetermined duration, after which step S404 instructs the cap on the reference side to execute w preliminary ejections.

This preliminary ejection control is completely independent of the preliminary ejection control steps S407 to S413 and thus, if the wait condition is satisfied, takes an independent value for the number of preliminary ejections w. When the wait condition is met, the time that elapses from the previous ejection becomes longer than normal, so that w generally takes a large value. After w preliminary ejections are executed at the cap on the reference side, a normal print scan is initiated while, on the non-reference side, the preliminary ejection control as dictated by steps S407 to S413 is performed so long as no such situation as satisfies the wait condition occurs again. If at step S402 the position where a wait is inserted is found not on the reference side, that is, on the non-reference side, step S405 causes the print head to stand by for a predetermined length of time before w preliminary ejections are executed at the preliminary ejection port on the non-reference side. This preliminary ejection control is completely independent of the preliminary ejection control steps S407 to S413 and thus, if the wait condition is satisfied, takes an independent value for the number of preliminary ejections w. After w preliminary ejections are executed at the preliminary ejection port on the non-reference side, a normal print scan is initiated while, on the reference side, the preliminary ejection control as dictated by steps S407 to S413 is performed so long as no such situation as satisfies the wait condition occurs again. Although the numbers of preliminary ejections performed at the cap on the reference side and at the preliminary ejection port on the non-reference side have both been set at w, they may be differentiated.

As described above, since the print method of this embodiment determines the position at which to execute a session of preliminary ejections (at the cap or the preliminary ejection) according to the scan range of the carriage carrying the print head, a degradation of throughput can be prevented. In this embodiment, a decision is made as to the location of the preliminary ejection receiving unit that executes a preliminary ejection session, according to the print data width and the print medium width. The print data width is used to determine whether the preliminary ejection session is to be executed mainly at only the cap on the reference side or at both the cap on the reference side and the preliminary ejection port on the non-reference side. Further, according to the print medium width, one preliminary ejection port at which to execute the preliminary ejection session is chosen from a plurality of preliminary ejection ports, allowing an appropriate preliminary ejection port for the size of the print medium and closest to the reference side to be used for the preliminary ejections. This eliminates unnecessary carriage scans.

Further, in determining the position (cap and preliminary ejection port) at which to execute a preliminary ejection session, the range where print data exists is precisely determined. This reduces unnecessary carriage movements, making greater contributions to improving throughput. In the above embodiment, the print data width Li has been defined to be a distance (width) in the scan direction as measured from the reference side end of a print medium to a far side end of a region where print data (ink ejection data) exists. Therefore, even in a case where an image (ink ejection data) exists only in a small area near the non-reference side end of the print medium and the carriage reciprocates over that area on the non-reference side, the print data width Li is determined as being almost equal to the width of the print medium, resulting in the preliminary ejection session being executed redundantly at both the cap and the preliminary ejection port.

To deal with such a situation, the range in which print data exists is examined both from the reference side and from the non-reference side. If an image (ink ejection data) is found to be only on the non-reference side, the preliminary ejection session is controlled to be executed only at the preliminary ejection port, thus improving throughput. This arrangement can prevent the preliminary ejections from being executed concentratedly at the preliminary ejection port alone, which would otherwise be caused by the location at which to execute preliminary ejections being chosen based on the print data width Li as measured only from the reference side end. Therefore, even in cases where the preliminary ejection port on the non-reference side has no suction mechanism and thus cannot discharge the ink squirted by the preliminary ejections, the problem of waste ink overflow can be dealt with by the above arrangement.

It is noted here that the preliminary ejection control based on wait conditions does not necessarily need to be performed. If the wait is not taken into account, the steps S401 to S406 in the flow chart of FIG. 4 are eliminated and the control follows the flow of step S407-S413.

It is also noted that, in determining the scan width Ls, this invention is not limited to three conditions—condition A, condition B and condition C—and any desired number of conditions, such as two conditions A and B or four conditions A, B, C and D, may be used. Furthermore, the printing system to which this embodiment is applicable is not limited to the one-way printing (backward printing) mentioned in the above explanation of this embodiment. This embodiment may also be applied to a one-way printing (forward printing) and a bidirectional printing.

(Second Embodiment)

Now, a second embodiment of this invention will be described. The basic configuration of this embodiment is similar to that of the first embodiment, so explanation will be given only to characteristic constructions. In this embodiment, values such as La, Lb, a, b, c and w are set for each print direction (forward, backward and bidirectional), for each kind of print medium and for each print mode (carriage speed, scan resolution and output resolution). Under a printing condition that will make quality degradations of image easily noticeable, this embodiment sets a more stringent threshold value to increase the number of preliminary ejections to reduce image quality degradations. Further, under a printing condition that will make an image quality degradation less noticeable, the threshold is alleviated to reduce the number of preliminary ejections. This arrangement can minimize the volume of waste ink, running cost and degradation of throughput. This embodiment allows for a more precise control of preliminary ejections and therefore a further optimization of the preliminary ejection control.

(Third Embodiment)

A third embodiment of this invention will be explained. The basic configuration of this embodiment is similar to that of the first embodiment, so only characteristic constructions will be described. In this embodiment, values such as La, Lb, a, b, c and w are set for each print environment (ambient temperature and ambient humidity). Under a print environment that will make image quality degradations easily noticeable, this embodiment sets a more stringent threshold value to increase the number of preliminary ejections to alleviate image quality degradations. Under a print environment that will make image quality degradations hardly noticeable, the threshold value is alleviated to reduce the number of preliminary ejections. This arrangement has made it possible to minimize the volume of waste ink, running cost and degradation of throughput. This embodiment has allowed for a more precise control, and therefore a further optimization, of preliminary ejections.

(Fourth Embodiment)

A fourth embodiment of this invention will be described. Since the basic configuration of this embodiment is similar to that of the first embodiment, only characteristic constructions will be explained. In this embodiment, values such as La, Lb, a, b, c and w are set for each distance between the print head and a print medium. For example, where the distance between the print head and the print medium is large, depending on the kind of print medium, a threshold is set at a more stringent value to increase the number of preliminary ejections. On the other hand, where the distance between the print head and the print medium is small, the threshold is set to a more alleviated value to reduce the number of preliminary ejections.

The above arrangement has made it possible to reduce image quality degradations when the distance between the print head and the print medium is large and, when that distance is small, to minimize the volume of waste ink, running cost and throughput degradations. With this embodiment a more precise control has been made possible, realizing a further optimization of the preliminary ejection control.

The first through the fourth embodiment may be used in any desired combination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-066325, filed Mar. 18, 2009, which is hereby incorporated by reference herein in its entirety.

What is claimed is:

1. An inkjet printing apparatus comprising:

a print head provided with a plurality of ejection ports for ejecting ink on a print medium;

a carriage configured to move said print head back and forth along a path extending in a first direction;

a plurality of ink reception units each capable of receiving ink ejected from said print head, said plurality of ink reception units including:

a first ink reception unit provided on one side of the print medium;

a second ink reception unit provided on the other side of the print medium and corresponding to a print medium of a first size; and a third ink reception unit provided on the other side of the print medium and corresponding to a print medium of a second size; and a decision unit for deciding which of said plurality of ink reception units to use, based on a size of the print medium in the first direction and a size of an image to be printed on the print medium in the first direction.

2. An inkjet printing apparatus according to claim 1, further comprising a feeding unit configured to feed a print medium in a second direction crossing the first direction, wherein said feeding unit is capable of feeding multiple types of print media, the print media being of differing sizes in the first direction.

3. An inkjet printing apparatus according to claim 2, wherein said feeding unit feeds the print medium such that one side of the print medium always passes the same location regardless of the size of the print medium.

4. An inkjet printing apparatus according to claim 3, wherein said print head prints against another side of the print medium in the case where the size of the image in the first direction is smaller than the size of the print medium in the first direction.

5. An inkjet printing apparatus according to claim 1, wherein said decision unit decides such that, among said plurality of ink reception units, an ink reception unit at a position outside of the print medium is used.

6. An inkjet printing apparatus according to claim 1, wherein said decision unit decides such that said first ink reception unit is used in the case where the size of the image in the first direction is equal to or smaller than a third size that is half the size of the first size, wherein said decision unit decides such that said first ink reception unit and said second ink reception unit are used in the case where the size of the image in the first direction is larger than the third size and the size of the print medium in the first direction is equal to smaller than the second size, and wherein said decision unit decides such that said first ink reception unit and said second ink reception unit are used in the case where the size of the image in the first direction is larger than the third size and the size of the print medium in the first direction is larger than the third size.

7. An inkjet printing apparatus according to claim 6, wherein said first ink reception unit is a cap capable of protecting an ejection port surface of said print head.

8. An inkjet printing apparatus according to claim 1, wherein said decision unit also decides a number of ejections to be ejected into a ink reception unit decided to be used, based on the size of the print medium in the first direction and the size of the image printed on the print medium.

9. An inkjet printing apparatus according to claim 8, wherein said decision unit decides the number of ejections based on environmental temperature and environmental humidity.

10. An inkjet printing apparatus according to claim 1, wherein said print head includes heaters that generate heat energy for ejecting ink, corresponding to each of said plurality of ejection ports.

* * * * *